United States Patent [19]

Dietlein

[11] Patent Number: 4,743,003

[45] Date of Patent: May 10, 1988

[54] SKI VISE WITH ROTATING JAWS

[76] Inventor: Robert W. Dietlein, 3040 Deer Run Rd., Carson City, Nev. 89701

[21] Appl. No.: 23,785

[22] Filed: Mar. 9, 1987

[51] Int. Cl.[4] ..... B25B 1/20

[52] U.S. Cl. ..... 269/43; 269/99; 269/153; 269/154; 269/204; 269/258; 269/906

[58] Field of Search ..... 269/43, 99, 152–154, 269/166–170, 258, 261, 906, 204

[56] References Cited

U.S. PATENT DOCUMENTS

| | | | |
|---|---|---|---|
| 357,524 | 2/1887 | Denney | 269/258 |
| 1,844,616 | 2/1932 | Whiton | 269/258 |
| 2,631,483 | 3/1953 | Swain | 269/204 |
| 2,926,922 | 3/1960 | Vermette | 269/258 |
| 3,850,422 | 11/1974 | Kwas | 269/204 |
| 3,861,664 | 1/1975 | Durkee | 269/906 |
| 4,241,906 | 12/1980 | Cole | 269/906 |
| 4,341,375 | 7/1982 | Romanin | 269/906 |

FOREIGN PATENT DOCUMENTS

| | | | |
|---|---|---|---|
| 40350 | 7/1907 | Switzerland | 269/261 |

*Primary Examiner*—Robert C. Watson
*Attorney, Agent, or Firm*—William W. Haefliger

[57] ABSTRACT

A ski holder includes:

(a) rotatable jaws having first generally longitudinally extending axis of rotation, (b) two supports for the jaws having sockets in which the jaws are rotatable about the axes, (c) the supports located for relative movement so that when a ski is placed between the jaws with its opposite sides positioned to be gripped thereby, the jaws rotatably accomodate to said ski sides as the jaws are relatively closed toward said sides.

14 Claims, 2 Drawing Sheets

SKI VISE WITH ROTATING JAWS

BACKGROUND OF THE INVENTION

This invention relates generally to ski holding devices, and more particularly to a ski vise with rotating jaws.

There is need for a device to allow rapid viselike mounting or supporting of skis, such as tapered side skis, to be worked on in ski shops. For example, skis must desirably be held in fixed position to allow waxing of ski bottom surfaces, or their repair.

SUMMARY OF THE INVENTION

It is a major object of the invention to provide a rugged, easily adjusted, vise apparatus permitting rapid positioning and firm retention of skis having tapered sides, in positions to be waxed, repaired, etc., in work shops. Basically, the device or holder comprises:

(a) rotatable jaws having first generally longitudinally extending axes of rotation, (b) two supports for the jaws having sockets in which the jaws are rotatable about said axes, (c) and means locating said supports for relative movement so that when a ski is placed between the jaws with its opposite sides positioned to be gripped thereby, the jaws rotatably accommodate to said ski sides as the jaws are relatively closed toward said sides.

As will appear, the sockets typically define partial cylinders, the sockets opening toward one another; and the jaws are generally longitudinally elongated and have partial cylindrical surfaces received in said sockets. In addition the jaws may have generally longitudinally extending serrations on sides of the jaws that face one another.

It is another object of the invention to provide a base carrying said supports, one support having fixed position relative to the base, and said (c) means including a member to displace the other support toward and away from the one support. The member is typically rod-like and extends laterally to carry the other support, and a guide is provided on the base to guide lateral movement of said member, and a clamp on the base to clamp said member in selected lateral position thereof.

A further objective is to provide sockets that taper, longitudinally, and the jaws loosely interfit the sockets to allow adjustment of the degree of jaw taper relative to socket taper, in response to forcible closing of the jaws against the ski sides.

Finally, the apparatus may include four supports, four sockets, and four rotatable jaws relatively adjustable to accurately adjust to and grip the opposite sides of two skis, such as matching skis of a skier.

These and other objects and advantages of the invention as well as the details of an illustrative embodiment, will be more fully understood from the following specification and drawings, in which:

DRAWING DESCRIPTION

DETAILED DESCRIPTION

Figure 1:
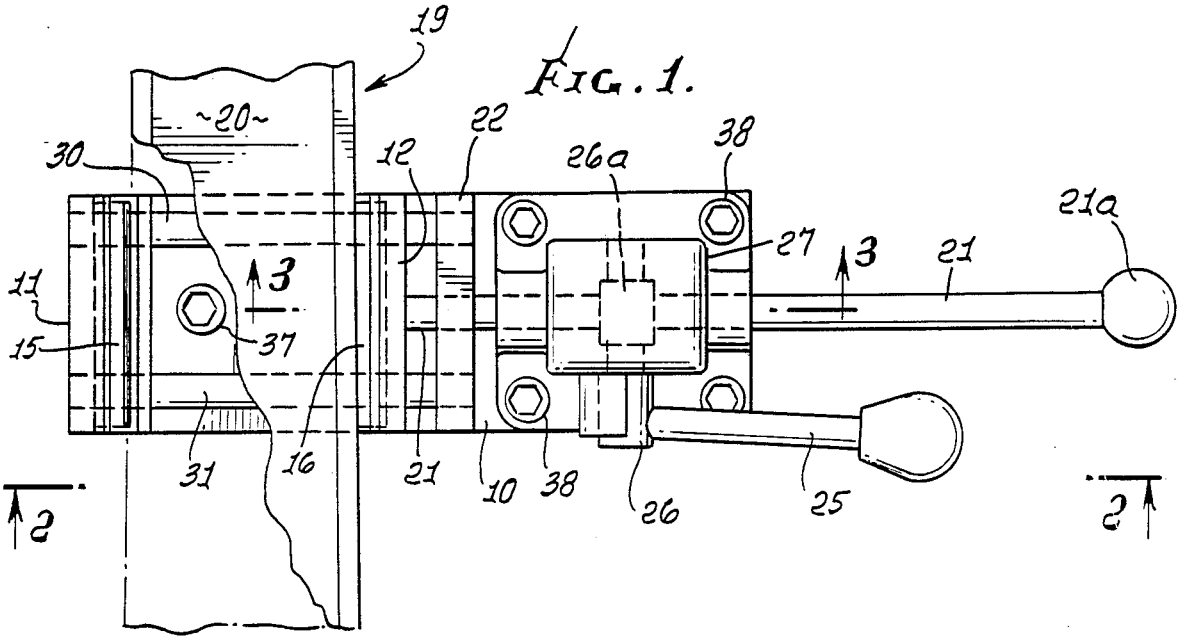
FIG. 1 is a plan view of apparatus incorporating the invention.
Figure 4:
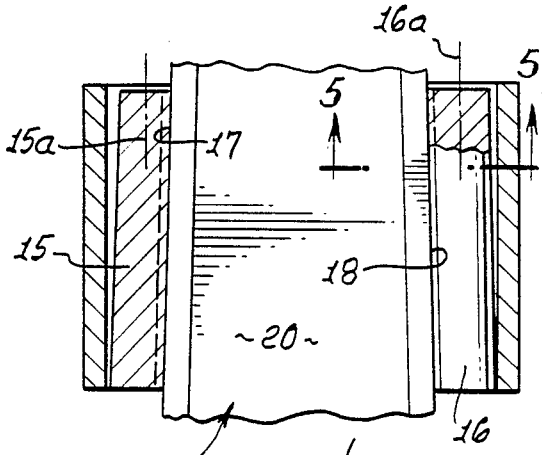
FIG. 4 is a fragmentary plan view showing retention of a ski.

In FIG. 1, a horizontal base plate 10 carries and locates a first upright support 11. A second upright support 12 is also provided and is laterally spaced from support 11. The two supports have sockets 13 and 14 respectively for two rotatable jaws indicated 15 and 16 The jaws have generally longitudinal and horizontal axes of rotation 15*a* and 16*a;* however, such axes and the elongated jaws may be seen to taper toward one another, in FIG. 4, especially when the jaws adjustably engage against opposite sides 17 and 18 of the ski 19, for mounting the ski so that its top face 20 may be processed (waxing, for example) The rod-like jaws have partial cylindrical surfaces 15*b* and 16*b* received in and loosely confined by the sockets which may also define partial cylindrical surfaces, the confinement allowing limited adjustment shifting of the jaws both as to relative taper, as referred to, and also rotatable accommodation of the jaws to the ski sides. In this regard, the jaws are shown to have generally longitudinally extending serrations 15*c* and 16*c* at the sides of the jaws facing one another, for gripping the ski sides as the jaws rotatably adjust in their sockets to conform the gripping serrations to the ski sides, which may be variably angled. See for example the angularity in FIG. 2.

Means is also provided for locating said supports for relative movement so that when a ski is placed between the jaws with its opposite sides positioned to be gripped thereby, the jaws rotatably accommodate to said ski sides as the jaws are relatively closed toward said sides. Such means may advantageously include a rod-like member 21 carrying support 12 at one end thereof, for displacing that support toward and away from fixed support 11, to achieve closing of the jaws on the opposite sides of the ski. A guide 22 fixed on the base has a bore 23 within which member 21 is guidedly laterally slidable. A clamp 24 is also provided on the base to clamp the member 21 in selected lateral position. See handle 25 that is swingable to rotate an axle 26 in a journal block 27, whereby a cam 26*a* on the axle bears down on the member 21 to clamp it against a surface of member 21 slidable in bore 28. Auxiliary rods 30 and 31 extend from block 27 to fixed support 11, for supporting same against lateral deflection.

The member 21 and support 12 may advantageously have a connection defined as:

(i) a lateral lost motion connection providing for coarse adjustment laterally of said other support.

The lost motion connection is seen to comprise an internal flange 32 located between rod shoulders 33 and 34. The spacing between the latter is greater than the width of the flange 32, whereby the support may self-adjust on the end member 21 in response to tightening engagement of the jaws with the ski opposite sides Shoulder 33 is defined by the head 35*a* of a fastener 35 threaded at 36 into the end of rod member 21.

Note hold down bolts 37 and 38.

Figure 6:
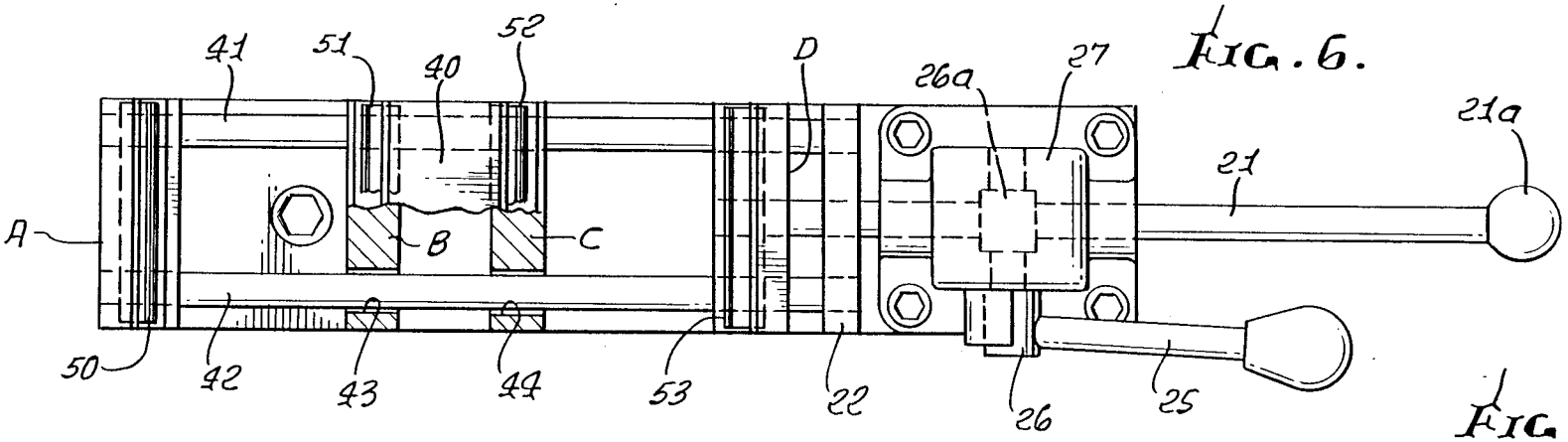
FIG. 6 is a view like FIG. 1, showing a modification.
Figure 5:
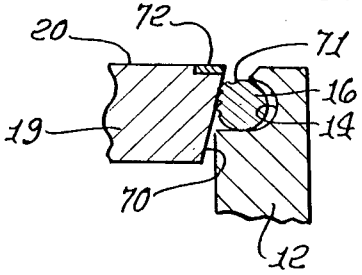
FIG. 5 is an enlarged section on lines 5—5 of FIG. 4.
Figure 7:
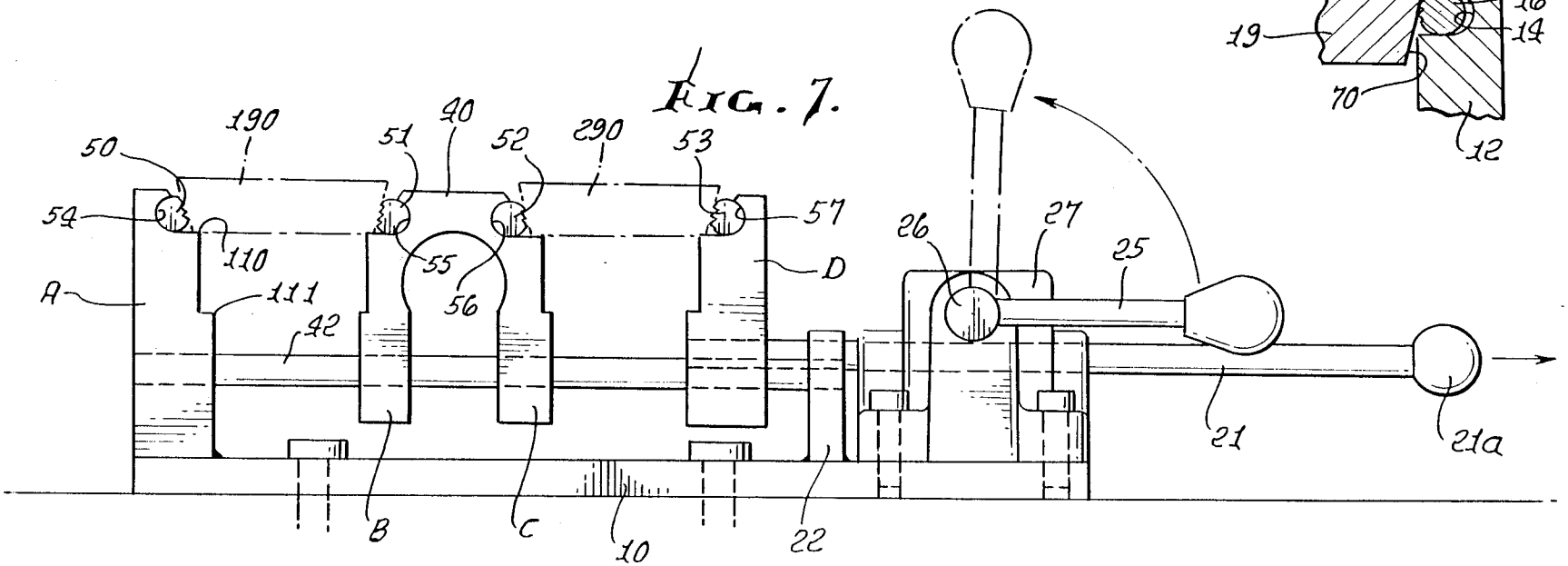
FIG. 7 is a front elevational view of the FIG. 6 apparatus.

In FIGS. 6 and 7 the construction is generally similar to that of FIGS. 1–4, and corresponding elements bear the same numerals. However, there are four jaw supports A, B, C and D. Supports A and D correspond generally to supports 11 and 12 referred to above, and supports B and C are added. Primary support A of the first pair of supports A and B has fixed position on and relative to the base, and the remaining supports B, C and D are movable laterally relative to support A. Secondary support B of the first pair A and B, and primary support C of the second pair of supports C and D have integral connection, as at 40, and supports B and C are slidable along the two rods 41 and 42 that extend between block 22 and fixed support A. For example, the rods may pass through guide bores 43 and 44 in the supports B and C. Support D is moved laterally by sliding of rod member 21, as before.

Handle 21*a* on that member affords this manual adjustment, as before. During such adjustment, the two skis 190 and 290 are clamped between the two pairs of jaws 50, 51 and 52 and 53. Jaws 50 and 51 are loosely carried in sockets 54 and 55 on members A and B; and jaws 52 and 53 are loosely carried in sockets 56 and 57 on members C and D. Supports B and C self adjust along rods 40 and 41, during the ski clamp-up process. The jaws and sockets have the same construction as described in FIGS. 1–5.

In the drawings, note the tapered sides 70 of the skis gripped by the jaws; the latter have clearance at 71 to avoid contact with ski metal strip 72. See FIG. 5.

Figure 2:
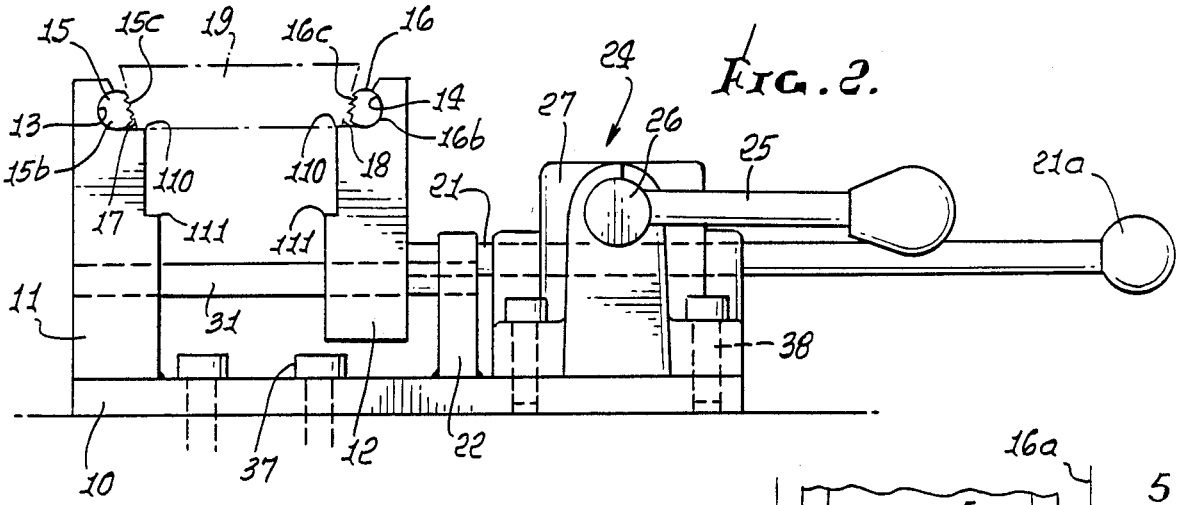
FIG. 2 is a side elevation on lines 2—2 of FIG. 1.
Figure 3:
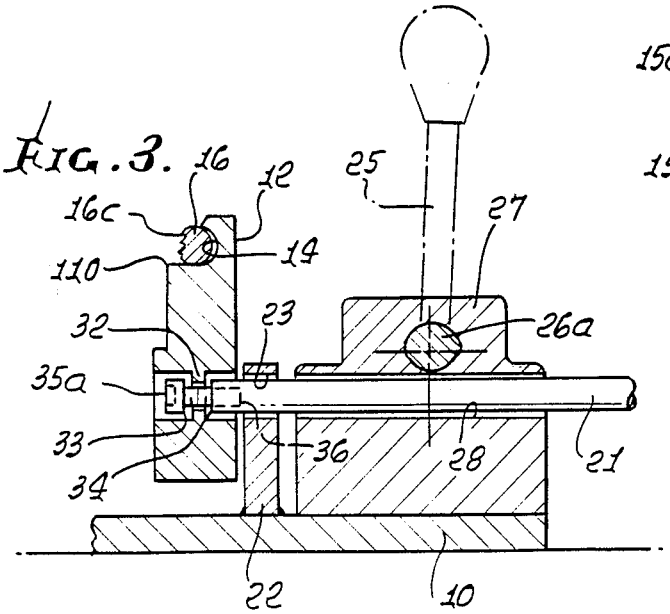
FIG. 3 is a section in elevation on lines 3—3 of FIG. 1.

Also shown in FIGS. 2, 3 and 7 are upward facing shoulders 110 on supports 11 and 12, and on supports A, B, C, and D to locate and support the ski or ski bottom surfaces in clamped position or positions of the ski shoulders 111 on such members to support ski edges in ski widthwise vertical positions, if need be.

I claim:

1. In a ski holder, the combination comprising (a) rotatable jaws having a first generally longitudinally extending axis of rotation, (b) two supports for the jaws having sockets in which the jaws are rotatable about said axes, (c) and means locating said supports for relative movement so that when a ski is placed between the jaws with its opposite sides positioned to be gripped thereby, the jaws rotatably accommodate to said ski sides as the jaws are relatively closed toward said sides, (d) said jaws tapering, longitudinally, and, (e) said sockets tapering, longitudinally, and the jaws loosely interfitting the sockets to allow adjustment of the degree of jaw taper relative to socket taper, in response to forcible closing of the jaws against the ski sides.

2. The combination of claim 1 wherein said sockets define partial cylinders, the sockets opening toward one another.

3. The combination of claim 2 wherein the jaws are generally longitudinally elongated and have partial cylindrical surfaces received in said sockets.

4. The combination of claim 3 wherein the jaws also have generally longitudinally extending serrations on sides of the jaws that face one another.

5. The combination of claim 1 including a base carrying said supports, one support having fixed position relative to the base, and said last named means including a member to displace the other support toward and away from the one support.

6. The combination of claim 5 wherein said member extends laterally and carries said other support, and including a guide on the base to guide lateral movement of said member, and a clamp on the base to clamp said member in selected lateral positions thereof.

7. The combination of claim 6 wherein said member and said other support have a connection defined as:

(i) a lateral lost motion connection providing for coarse adjustment laterally of said other support.

8. The combination of claim 1 including additional structure including rotatable jaws and additional two supports as defined in claim 1, for holding a second ski, and said last named means also operatively connected with said additional structure to locate said additional supports for relative movement when a ski is placed between said additional two jaws.

9. The combination of c1aim 8 wherein the sockets of each pair define partial cylinders, the sockets opening toward one another.

10. The combination of claim 9 wherein the jaws of each pair are generally longitudinally elongated and have partial cylindrical surfaces received in said sockets.

11. The combination of claim 10 wherein the jaws of each pair also have generally longitudinally extending serrations on sides of the jaws that face one another.

12. The combination of claim 4 including said ski having its sides tapered and engaged by the jaws, the jaws having clearance near the serrations to avoid engagement with metal strips on the ski.

13. The combination of claim 1 including upward facing first shoulder means on at least one of said supports to vertically locate the underside of a ski when its opposite sides are gripped by said jaws.

14. The combination of claim 13 including at least one additional shoulder carried by at least one of said supports at a level lower than that of said first shoulder means, to locate and support the edge of a ski placed widthwise vertically between said jaws.

* * * * *